US009305761B2

(12) United States Patent
Jarrell

(10) Patent No.: US 9,305,761 B2
(45) Date of Patent: Apr. 5, 2016

(54) ION SOURCE FOR MASS SPECTROMETER AND METHOD OF PRODUCING ANALYTE ION STREAM

(71) Applicant: Waters Technologies Corporation, Milford, MA (US)

(72) Inventor: Joseph A. Jarrell, Newton Highlands, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 14/458,311

(22) Filed: Aug. 13, 2014

(65) Prior Publication Data

US 2015/0048255 A1 Feb. 19, 2015

Related U.S. Application Data

(60) Provisional application No. 61/865,714, filed on Aug. 14, 2013.

(51) Int. Cl.
*H01J 49/16* (2006.01)
*H01J 49/04* (2006.01)

(52) U.S. Cl.
CPC ..... *H01J 49/16* (2013.01); *H01J 49/0454* (2013.01)

(58) Field of Classification Search
USPC ..... 250/424, 288, 281, 282, 423 F, 423 R, 250/425, 426, 427
See application file for complete search history.

(56) References Cited

U.S. PATENT DOCUMENTS

| | | | | |
|---|---|---|---|---|
| 6,396,057 | B1 | 5/2002 | Jarrell et al. | |
| 7,368,728 | B2 | 5/2008 | Cristoni et al. | |
| 8,232,520 | B2 | 7/2012 | Cristoni | |
| 2001/0042829 | A1 * | 11/2001 | Apffel | G01N 30/7253 250/288 |
| 2007/0075240 | A1 * | 4/2007 | Hieke | H01J 49/04 250/282 |
| 2011/0036974 | A1 | 2/2011 | Franzen et al. | |

FOREIGN PATENT DOCUMENTS

| | | |
|---|---|---|
| CN | 102637574 | 8/2012 |
| WO | 2012/143737 | 10/2012 |

OTHER PUBLICATIONS

Cristoni et al., "*The Role of Different Phenomena in Surface-Activated Chemical Ionization (SACI) Performance*", Journal of Mass Spectrometry, vol. 40, pp. 1550, 2005.
Hager, "*Investigations Into Exploding Droplets*", 1997.

(Continued)

*Primary Examiner* — Phillip A Johnston
*Assistant Examiner* — Hsien Tsai
(74) *Attorney, Agent, or Firm* — Diederiks & Whitelaw, PLC

(57) ABSTRACT

An ion source for a mass spectrometer and a method of ionizing a sample are disclosed. A droplet generator is configured to emit a stream of analyte droplets, which are ionized upon impact with a target, thus forming an ion stream. Preferably, the droplets have a diameter that is greater than a preset value to increase the kinetic energy of the droplets. Additionally, the droplet generator can be configured to create a gas flow that increases the kinetic energy of the droplets. In one embodiment, the target is positioned upstream of an inlet of a mass spectrometer so that the ion stream enters the inlet. In another preferred embodiment, the target is positioned downstream of the inlet so that the stream of droplets passes through the inlet of the mass spectrometer, and the inlet is provided with a pressure drop that increases the kinetic energy of the droplets.

22 Claims, 8 Drawing Sheets

(56) References Cited

OTHER PUBLICATIONS

Hager et al., "*Droplet Electrospray Mass Spectrometry*", Analytical Chemistry, vol. 66, No. 22, pp. 3944-3949, 1994.

Liu et al., "*Development and Applications of Paper-Based Electrospray Ionization-Mass Spectrometry for Monitoring of Sequentially Generated Droplets*", The Royal Society of Chemistry, vol. 138, pp. 2163-2170, 2013.

Luo et al., "*Generation of Picoliter Droplets of Liquid for Electrospray Ionization with Piezoelectric Inkjet*", Journal of Mass Spectrometry, vol. 48, pp. 321-328, 2013.

Major et al., "*A Novel Source Design for the Analysis of Both Polar and Non-Polar Species*", ASMS 2012.

Mowery, "*Two Sensitive Detectors for Liquid Chromatography—The Flame Aerosol Detector and the Spray Impact Detector*", Xerox University Microfilms, 1974.

Welch, "*Investigation of the Spray Impact Detector With Active Metal Targets*", Xerox University Microfilms, 1976.

* cited by examiner

ION SOURCE FOR MASS SPECTROMETER AND METHOD OF PRODUCING ANALYTE ION STREAM

CROSS-REFERENCE TO RELATED APPLICATION

This application claims the benefit of U.S. Provisional Patent Application Ser. No. 61/865,714, filed on Aug. 14, 2013. The entire content of this application is incorporated herein by reference.

FIELD OF THE INVENTION

The present invention relates to an ion source for a mass spectrometer and a method of ionizing a sample for use with a mass spectrometer.

BACKGROUND OF THE INVENTION

Atmospheric Pressure Ionization ("API") ion sources are commonly used to ionize the liquid flow from high-performance liquid chromatography ("HPLC") and higher pressure chromatography devices prior to analyzing the resulting gas phase ions via a mass spectrometer. Two techniques which are most commonly used comprise Electrospray Ionization ("ESI") and Atmospheric Pressure Chemical Ionization ("APCI"). ESI is optimal for moderate to high polarity analytes and APCI is optimal for non-polar analytes. API ion sources that combine both of these techniques have been proposed and realized in designs that simultaneously combine ESI and APCI ionization. Such "multimode" ion sources have the advantage of being able to ionize analyte mixtures containing a wide range of polarities in a single chromatographic run without the need to switch between different ionization techniques. Surface Activated Chemical Ionization ("SACI") is another type of ion source which directs a vapor stream from a heated nebulizer probe towards a broad area charged target plate which is situated close to the ion inlet aperture of the mass spectrometer. The spray point of the SACI ion source is within the heated nebulizer probe and is usually situated so that a relatively large distance exists between the sprayer and the target. Such distance produces a divergent spray with a dispersed reflected flow at the target, which generally results in lower sensitivities when compared to optimized ESI and APCI sources.

As described above, a SACI ion source converts a liquid stream into a vapor stream that then impinges on a broad area target. U.S. Pat. No. 7,368,728 discloses a known SACI ion source and is incorporated herein by reference in its entirety. Experiments on SACI (Cristoni et al., J. Mass Spectrom., 2005, 40, 1550) have shown that ionisation occurs as a result of the interaction of neutral analyte molecules in the gas phase with the proton rich surface of the broad area target. In contrast to SACI, a pneumatic nebulizer used for impact spray ionization utilizes a smaller target and emits a high density droplet column. Experiments involving pneumatic nebulizer ion sources (Bajic, WO/2012143737 published Oct. 26, 2012, incorporated herein by reference in its entirety) that utilize a streamlined target to intercept a high velocity stream of liquid droplets, which results in a secondary stream of secondary droplets, gas phase neutrals and ions, have demonstrated that such a technique can result in spray that is highly collimated with greater than two thirds of the total droplet mass of the spray being confined to a radius of 1 mm from the nebulizer or sprayer. However, an observed loss of sensitivity at lower flow rates makes these techniques undesirable for many applications. Use of pneumatically assisted nebulizers for producing an impacting spray is also well known in the art. This class of nebulizers is known to have the undesirable property of producing variably-sized droplets as the flow rate of the liquid stream to be nebulized decreases or drops. Therefore, there is a need in the art for an ion source for a mass spectrometer that improves sensitivity.

SUMMARY OF THE INVENTION

The present invention is directed to a method of ionizing a sample with an ion source for a mass spectrometer that incorporates the use of a droplet generator. While the exact mechanisms of ionization are not yet fully understood for impact spraying techniques, there is a relationship between the kinetic energy of droplets containing analyte that strike an impactor pin and the sensitivity of the impact spray technique. Droplet size correlates to the kinetic energy of the droplet; smaller droplets carry less kinetic energy than larger droplets; and viscous dampening from the surrounding air causes smaller droplets to lose their kinetic energy more rapidly than droplets having a larger diameter. Variability in droplet size and lower kinetic energy in the droplets accounts for the observed loss in sensitivity at lower flow rates.

According to an aspect of a preferred embodiment, there is provided an ion source for producing analyte ions from a sample containing analyte molecules. The ions are preferably sent to a mass spectrometer. The ion source comprises a droplet generator and a target such as an impactor pin. The impactor pin is typically placed at an electrical potential (with respect to electrical ground) ranging from +100 Volts to +5000 Volts when it is desired to produce positive ions. The impactor pin is typically placed at correspondingly negative electrical potentials when negative ions are desired. The droplet generator includes a first capillary tube having an exit and an actuator configured to expel a droplet from the first capillary tube through the exit in response to receiving an electrical signal. The droplet generator is configured to emit, from the exit, a stream of droplets having a uniform diameter, so that the droplets are caused to impact upon the target resulting in the production of analyte ions. In another preferred embodiment, the droplet generator further includes a second capillary tube, surrounding the first capillary tube, having an exit configured to provide a gas flow that increases the kinetic energy of the droplets. Preferably the second capillary tube is concentric with the first capillary tube and the exit of the first capillary tube is recessed relative to the exit of the second capillary tube. In yet another preferred embodiment, the exit of the first capillary tube is flush with the exit of the second capillary tube. The actuator preferably includes a piezoelectric element attached to the first capillary tube. The ion source has an electrical source configured to supply the piezoelectric element with electrical pulses at a preset frequency thereby producing droplets at that preset frequency, which is preferably between 100 Hz and 15 kHz and is most preferably 10 kHz.

In one preferred embodiment, the target is positioned upstream of an inlet of the mass spectrometer so that analyte ions formed upstream of the inlet enter the inlet of the mass spectrometer. The exit of the first capillary tube has a diameter that is greater than a preset value, preferably 30 μm, to increase the size and the kinetic energy of the droplets. In another preferred embodiment, the inlet of the mass spectrometer is provided with a pressure drop and the target is positioned downstream of the inlet so that the stream of droplets passes through the inlet of the mass spectrometer and the pressure drop increases the kinetic energy of the droplets.

In still another preferred embodiment, a corona discharge pin is positioned so that the droplets or the ion stream pass by the corona discharge pin.

In accordance with another aspect of the invention, there is provided a method of producing analyte ions from a sample containing analyte molecules. The method comprises generating a stream of droplets having a uniform diameter and a relatively large kinetic energy with a droplet generator. An electrical pulse is generated to expel a droplet from a first capillary tube through the exit with an actuator. The stream of droplets is caused to impact a target in order to produce analyte ions from analyte molecules contained in the droplets.

Preferably, increasing the kinetic energy of the droplets includes providing a gas flow to the exit of the first capillary tube through an exit of a second capillary tube that surrounds the first capillary tube. The actuator preferably includes a piezoelectric element attached to the first capillary tube. The stream of droplets is generated by supplying electrical pulses from an electrical source to the piezoelectric element at a preset frequency to produce the droplets at the preset frequency. Additionally, the method includes impacting the droplets into the target to create the analyte ions and then passing the ions through an inlet of a mass spectrometer, wherein increasing the kinetic energy of the droplets includes producing droplets with a diameter over 30 μm. In another preferred embodiment, increasing the kinetic energy of the droplets includes passing the droplets through the inlet of the mass spectrometer before impacting the droplets with the target and using a pressure drop across the inlet to increase a velocity of the droplets.

Droplets generated by the droplet generator are of uniform size, resulting in droplets having a more uniform kinetic energy than droplets produced by pneumatically assisted nebulizers. Additionally, the present invention incorporates a gas flow to aid in imparting kinetic energy to droplets formed by the droplet generator.

Additional objects, features and advantages of the present invention will become more readily apparent from the following detail description of preferred embodiments when taken in conjunction with the drawings wherein like reference numerals refer to corresponding parts in the several views.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
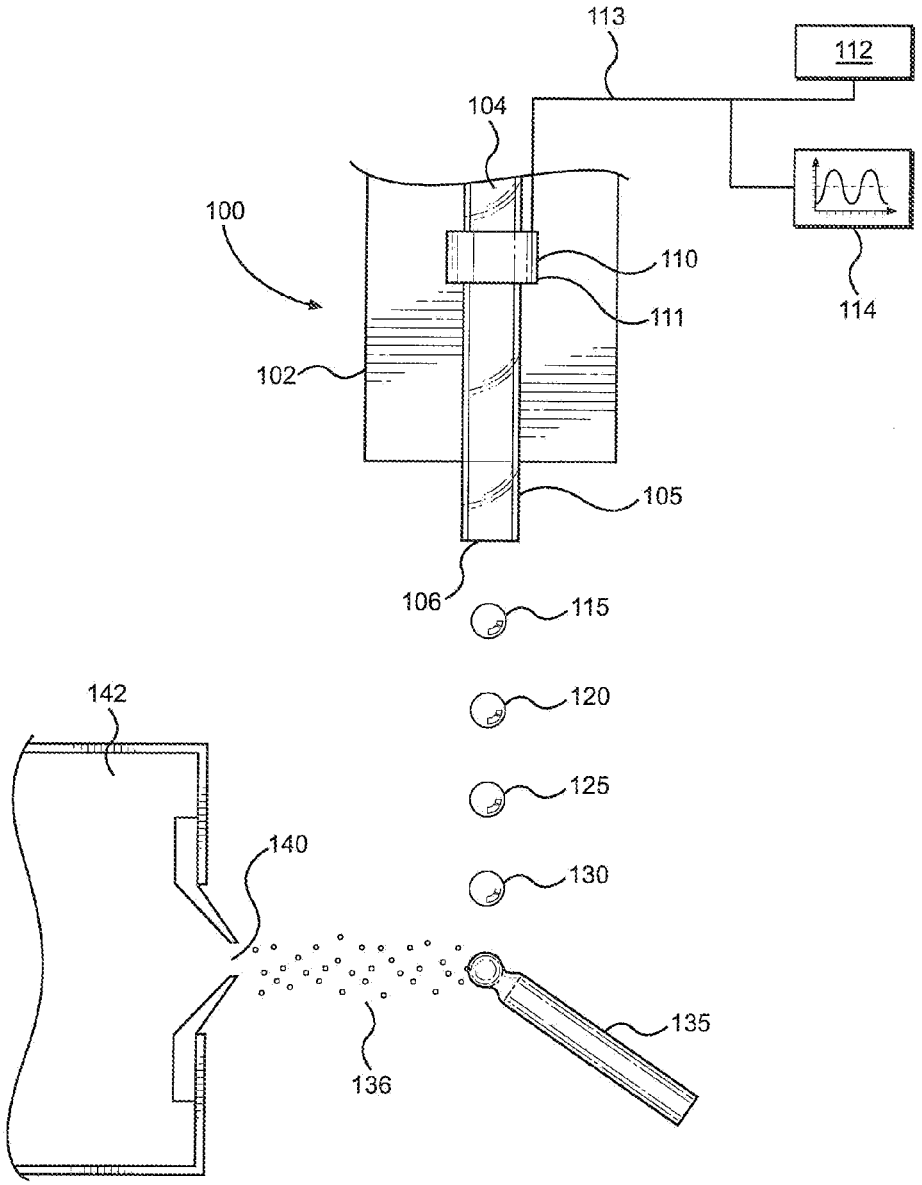
FIG. 1 shows an ion source for a mass spectrometer according to a preferred embodiment of the present invention including a droplet generator and a target located outside an ion inlet device of the mass spectrometer.

FIG. 1 shows a schematic of the general layout of an impactor spray ion source 100 using a droplet generator 102 according to a preferred embodiment of the present invention. A sample 104 containing analyte molecules is introduced into impactor spray ion source 100 for ionization. Droplet generator 102 converts sample 104 into a droplet or a stream including droplets 115, 120, 125, 130, which contain analyte molecules. Droplet generator 102 comprises a first capillary tube 105 having an exit 106 and an actuator 110. Actuator 110 includes a piezoelectric element 111, which is connected to an electrical source 112, through a line 113, that is capable of producing an electrical signal 114. Electrical signal 114 causes actuator 110 to generate a pressure pulse that causes a droplet or droplets 115, 120, 125, 130 to expel from exit 106 of first capillary tube 105. Electrical source 112 is configured to supply electrical signal 114 to actuator 110 as a series of pulses at a preset frequency thereby producing droplets 115, 120, 125, 130 at the preset frequency. For example, if actuator 110 is pulsed with a single, individual electrical signal pulse, a single droplet 115 expels from exit 106 of first capillary tube 105. By way of another example, when actuator 110 is pulsed with electrical signal 114 at a preset frequency, e.g., 10 kHz, droplets 115, 120, 125, 130 are expelled from exit 106 of first capillary tube 105 as the stream. Electrical source 112 is capable of pulsing an electrical signal at a range of different frequencies, for example frequencies between 100 Hz and 15 kHz, preferably 10 kHz. The desired frequency is preferably set before use to control a rate at which the output of droplet generator 102 produces droplets.

Piezoelectric element 111 generally comprises an electrically insulating material. Thus, the electric potential of first capillary tube 105 may be set independently of any electrical potential generated by electrical source 112. In general, it is convenient to set the electric potential of first capillary tube 105 at ground. In the event piezoelectric element 111 is electrically conductive, an electrically insulating barrier (not shown) is preferably interposed between piezoelectric element 111 and first capillary tube 105.

Droplets 115, 120, 125, 130 leave from exit 106 of first capillary tube 105 with a uniform diameter and a uniform kinetic energy. First capillary tube 105 has a diameter that is greater than a preset value, thereby producing the uniform diameter of droplets 115, 120, 125, 130 with increased kinetic energy compared to droplets having a diameter less than the preset value. Larger droplets hold kinetic energy more efficiently than smaller droplets and also lose kinetic energy more slowly than droplets that are smaller in size, such loss being attributable to viscous dampening from the surrounding air or atmosphere. In a preferred embodiment, the preset value is 30 μm. The diameter of droplets 115, 120, 125, 130 is substantially the same as the diameter of first capillary tube 105, which is larger than the preset value of 30 μm.

A target 135 is located downstream of droplet generator 102. An electrical potential is applied to target 135. When positive analyte ions are desired, target 135 is typically placed at an electrical potential (relative to first capillary tube 105 and an inlet 140 of a mass spectrometer 142) ranging from +100 Volts to +5000 Volts. Typically, first capillary tube 105 is grounded and inlet 140 is within plus or minus 100 Volts with respect to ground. When in use, the stream of droplets 115, 120, 125, 130 impacts upon target 135 and ions of analyte molecules are detected by mass spectrometer 142. Multiple ionization mechanisms may be involved in impact spray ionization. An ion stream 136 is formed as a result of the impacts of droplets 115, 120, 125, 130 with target 135. Ion stream 136 may comprise analyte ions, charged clusters of analyte molecules and mobile phase solvent molecules, and smaller secondary charged droplets which subsequently may generate ions before or after passing through inlet 140.

While the mechanisms of impact spray ionization are not completely understood, it is believed that the following parameters are important.

The formation of secondary droplets or a stream of secondary droplets, where the nature of the droplet breakup is determined by the Weber number $W_e$, which is given by the following:

$$W_e=\rho U^2 d/\sigma \quad (1)$$

wherein ρ is the droplet density, U is the droplet velocity, d is the droplet diameter and σ is the droplet surface tension. Impact upon the target leads to significant droplet breakup and produces a secondary ion stream, such as referenced at 136, that may include ions, charged droplets, neutrals, and clusters.

The impact efficiency of an ionization system may be influenced by the Stokes number $S_k$ where:

$$S_k=\rho d^2 U/18\mu a \quad (2)$$

wherein ρ is the droplet density, d is the droplet diameter, U is the droplet velocity, μ is the gas viscosity and a is the characteristic dimension of the target. Impact efficiency increases with increasing $S_k$ and thus favours large droplets with high velocity and a small target diameter. Impact efficiency may also increase with reducing Reynolds numbers The shape of the secondary stream will be influenced by gas flow dynamics and, in particular, the Reynolds number ($R_e$) which is given by:

$$R_e=\rho vL/\mu \quad (3)$$

wherein ρ is the gas density, v is the gas velocity, μ is the gas viscosity and L is the significant dimension of the target.

Target 135 is depicted in FIG. 1 as a pin with a round end. The pin lies in a plane formed by the axes of inlet 140 and first capillary tube 105 with the round end positioned roughly at the intersection of these two axes. In another preferred embodiment, the pin has a beveled end. In addition, target 135 may also be positioned along a third axis orthogonal to these two axes such that a central section of the pin is roughly at the intersection of the axes of inlet 140 and first capillary tube 105.

Figure 2:
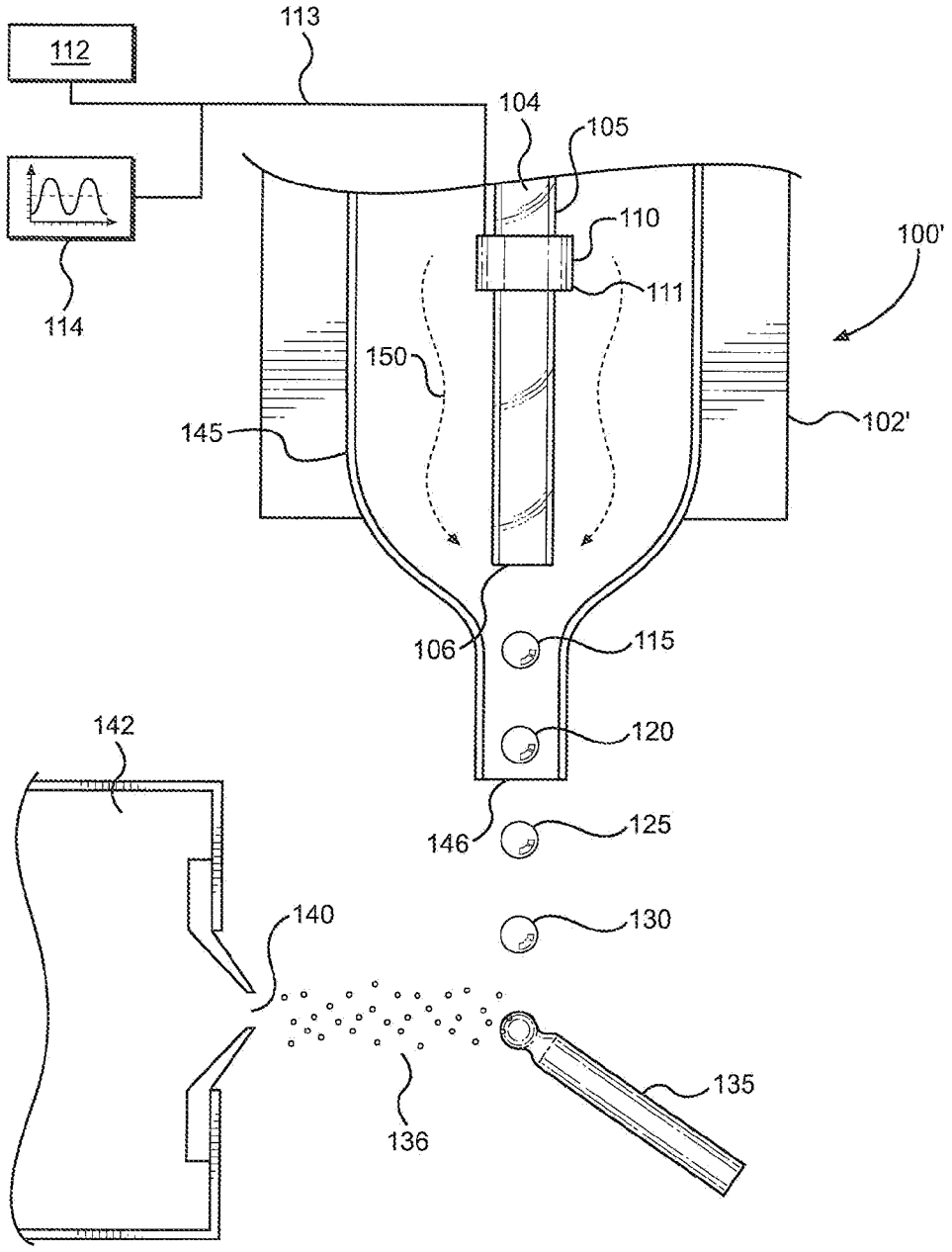
FIG. 2 shows an ion source according to an additional preferred embodiment of the present invention including a droplet generator and a target incorporating a capillary gas flow to aid in imparting kinetic energy to droplets formed by the droplet generator.

FIG. 2 shows a schematic of the general layout of an impactor spray ion source 100' incorporating a stream of capillary gas flow 150 to enhance the velocity of, and impart kinetic energy to, droplets 115, 120, 125, 130, according to an embodiment of the present invention. Sample 104, containing an analyte, is arranged to be delivered to a droplet generator 102'. First capillary tube 105 is housed inside a second capillary tube 145. Second capillary tube 145 has an exit 146 arranged and adapted to provide stream of gas flow 150 to exit 106 of first capillary tube 105. Capillary gas flow 150 entrains and accelerates droplets 115, 120, 125, 130, thus increasing the kinetic energy of droplets 115, 120, 125, 130 exiting first capillary tube 105. Preferably, second capillary tube 145 is concentric with first capillary tube 105 and exit 106 of first capillary tube 105 is recessed with respect to exit 106. In yet another preferred embodiment (not shown), exit 106 of first capillary tube 105 is flush with exit 146 of second capillary tube 145. In a further preferred embodiment, exit 106 of first capillary tube 105 protrudes with respect to exit 146 of second capillary tube 145. Gas flow 150 of the present invention acts to concentrate or trap droplets 115, 120, 125, 130 at the center of second capillary tube 145 as droplets 115, 120, 125, 130 exit first capillary tube 105 at exit 106. The concentric flow of high velocity gas from second capillary tube 145 around first capillary tube 105 entrains and accelerates droplets 115, 120, 125, 130 produced therewith and increases the kinetic energy of droplets 115, 120, 125, 130. The gas used to create gas flow 150 preferably includes nitrogen, argon, or helium. U.S. Pat. No. 6,396,057, incorporated herein by reference in its entirety, describes a way that ions can be entrained and accelerated by concentrating or trapping the ions with electrically biased electrodes.

In a preferred embodiment, second capillary tube 145 includes a wide portion and a narrow portion. The wide portion has a larger diameter than the narrow portion of second capillary tube 145, and the transition between the two portions is tapered. The wide portion surrounds first capillary tube 105 and tapers to form the narrow portion, which extends past exit 106 of first capillary tube 105. Capillary gas flow 150 increases in velocity when flowing through the narrow portion of second capillary tube 145, thereby increasing the kinetic energy imparted to droplets 115, 120, 125, 130 exiting exit first capillary tube 105 and traveling through the narrow portion of second capillary tube 145. In another embodiment (not shown), second capillary tube 145 is not tapered.

Figure 3:
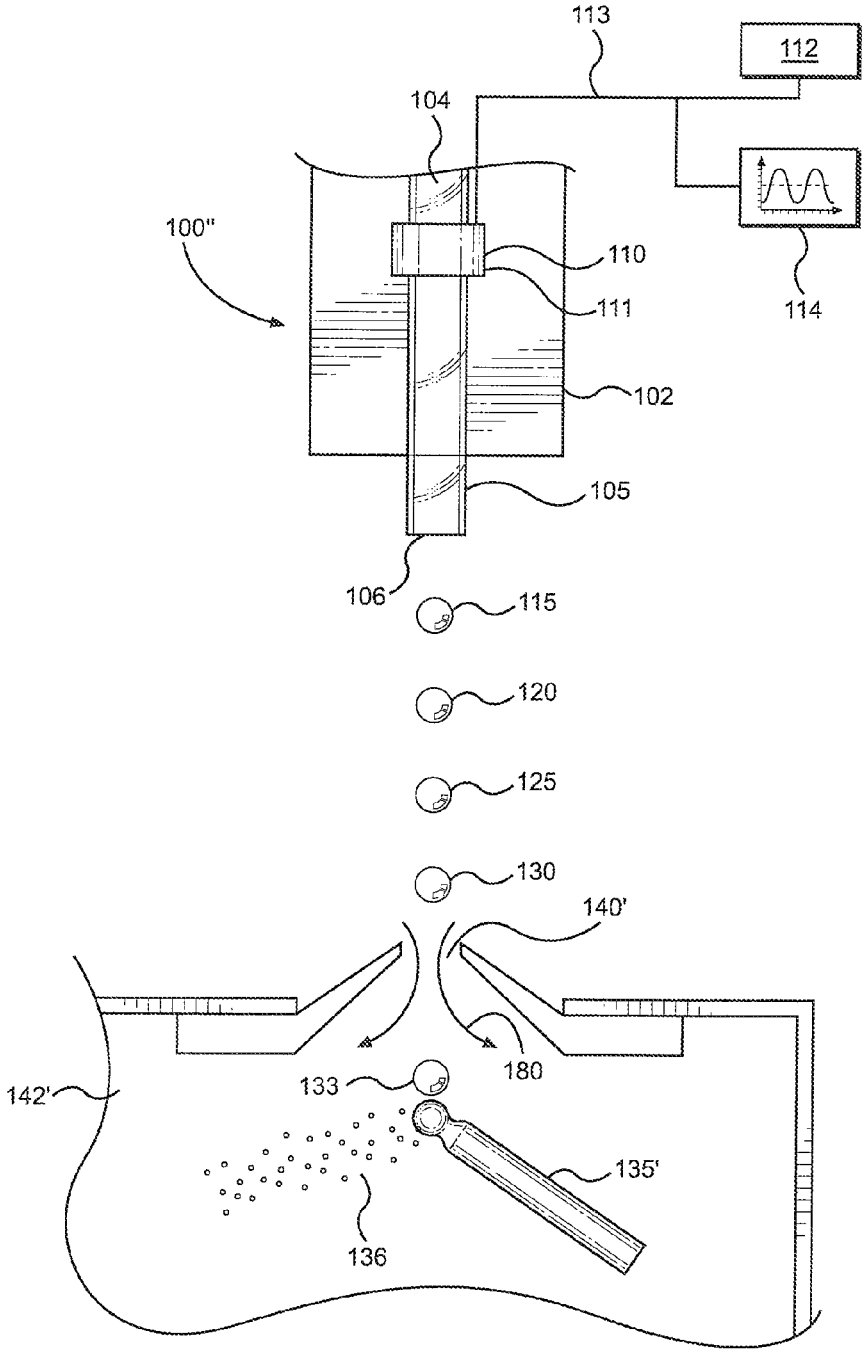
FIG. 3 shows an ion source according to a further preferred embodiment of the present invention including a droplet generator and a target located inside of an inlet device of a mass spectrometer.

FIG. 3 shows an embodiment of an impactor spray ion source 100" wherein a target 135' is located inside of an inlet 140' of a mass spectrometer 142'. Droplet generator 102 is aligned so that droplets 115, 120, 125, 130 and 133 enter directly into inlet 140' (see, for example, droplet 133) of mass spectrometer 142' before impacting upon target 135' to create ion stream 136. In one embodiment, inlet 140' is configured as a cone, although other embodiments may include inlet configurations such as a bent tube, a straight passage way or a contoured passageway. Across inlet 140' there exists a pressure drop of substantially 1 atmosphere, which generates an inlet gas flow 180, traveling close to the speed of sound, that imparts kinetic energy to droplets 115, 120, 125, 130, 133 upon entering mass spectrometer 142' through inlet 140'. Because the entirety of each droplet passes through inlet 140' (carried by inlet gas flow 180) before impacting upon target 135', ionization occurs inside mass spectrometer 142' thereby improving the efficiency of ion collection that occurs within mass spectrometer 142' and improving the sensitivity of the impact spray ionization technique.

Figure 4:
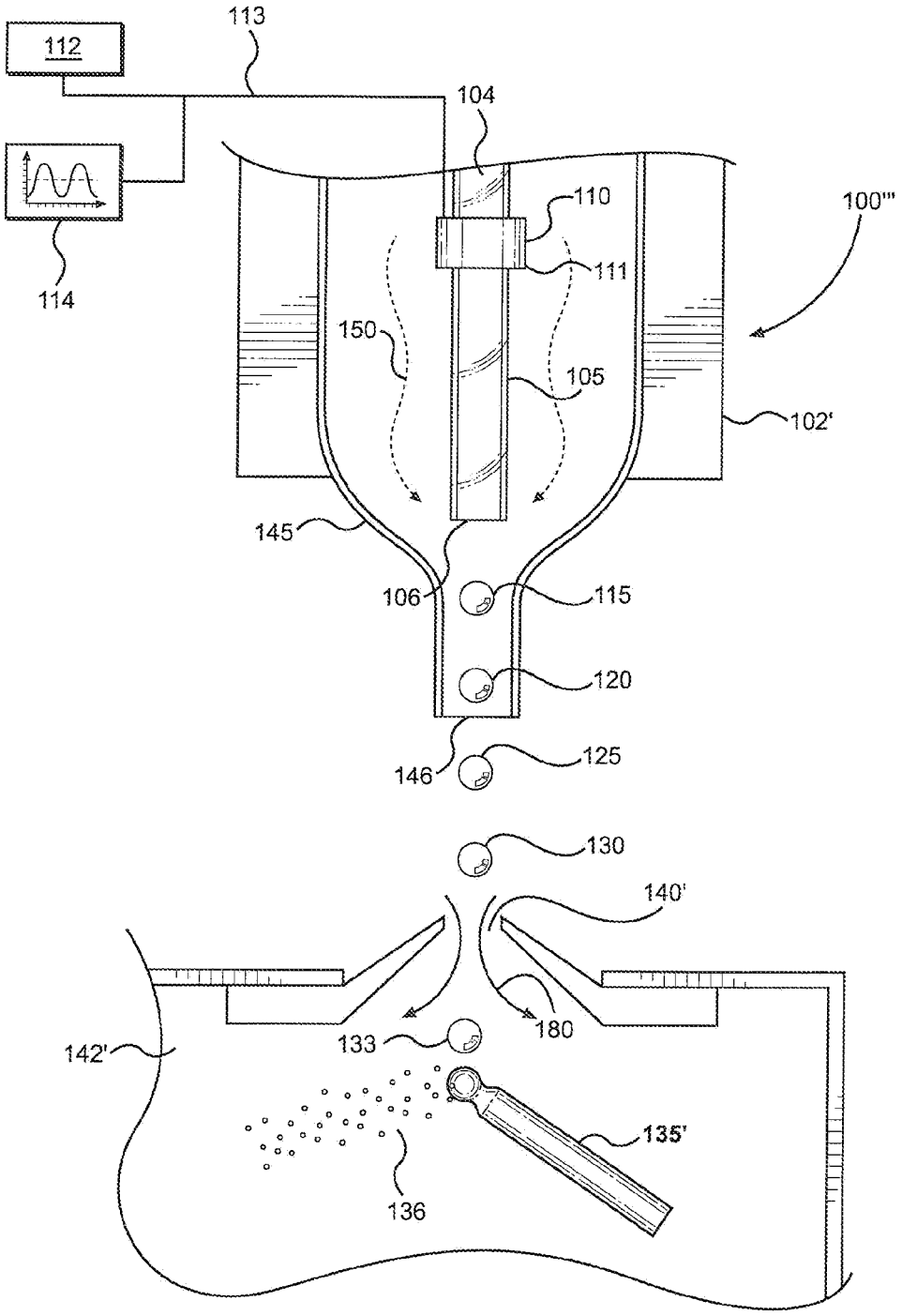
FIG. 4 shows an ion source according to a still further preferred embodiment of the present invention wherein a target is located inside of an inlet device of a mass spectrometer and an inlet gas flow aids in imparting kinetic energy to droplets formed by a droplet generator.

Referring now to FIG. 4, there is shown an embodiment of an impactor spray ion source 100''' including target 135', located inside of inlet 140' of mass spectrometer 142', and an inlet gas flow 180, which aids in imparting kinetic energy to droplets 115, 120, 125, 130, 133 formed by droplet generator 102'. Droplets 115, 120, 125, 130, 133 that exit from first capillary tube 105 at exit 106 are exposed to capillary gas flow 150 from second capillary tube 145, which causes them to gain kinetic energy from capillary gas flow 150. Further, as second capillary tube 145 narrows, droplets 115, 120, 125, 130, 133 accrue more kinetic energy and velocity. Exit 146 of second capillary tube 145 is aligned directly with mass spectrometer 142' so that droplets 115, 120, 125, 130, 133 are carried directly into inlet 140'. Due to the pressure drop across inlet 140' of mass spectrometer 142', inlet gas flow 180 is created, which imparts additional kinetic energy to droplets 115, 120, 125, 130, 133 as they enter mass spectrometer 142' through inlet 140'. Here again, the entirety of each droplet passes through inlet 140' (carried by inlet gas flow 180) before impacting upon target 135'. As such, ionization occurs inside mass spectrometer 142' thereby improving the efficiency of ion collection within mass spectrometer 142' and improving the sensitivity of the impact spray ionization technique.

Figure 5:
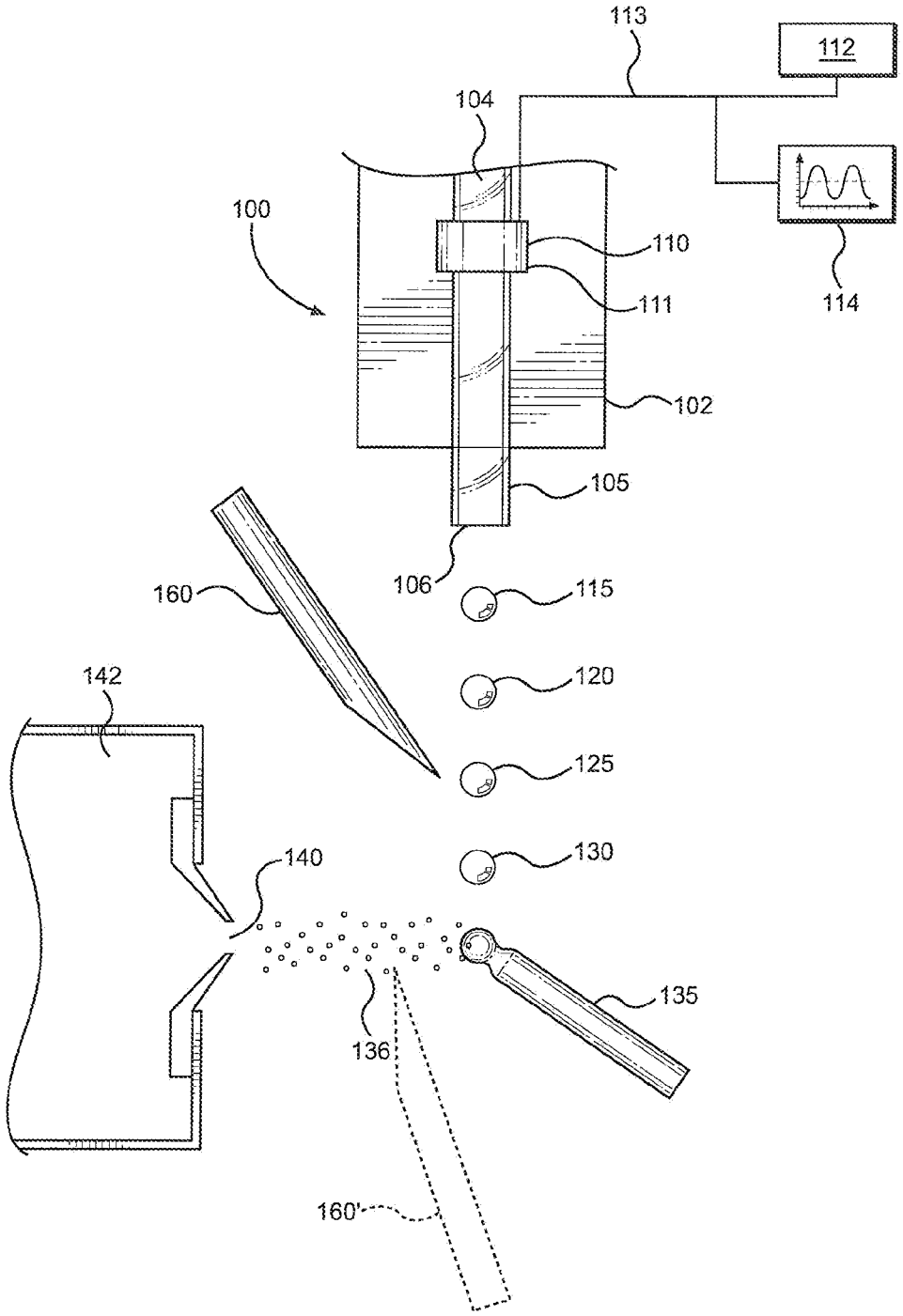
FIG. 5 shows the ion source of FIG. 1 with a corona discharge pin.

FIG. 5 shows an embodiment of the present invention having a corona discharge pin 160 incorporated into impactor spray ion source 100. In this embodiment, droplet generator 102 utilizes first capillary tube 105, actuator 110, electrical source 112 and electrical signal 114 for generating droplets 115, 120, 125, 130. Corona discharge pin 160 is oriented in the path of droplets 115, 120, 125, 130, between droplet generator 102 and target 135. Target 135 preferably has a similar dimension to that of first capillary tube 105. Corona discharge pin 160' is alternatively incorporated into impactor spray ion source 100 in the path of ion stream 136, located between target 135 and inlet 140.

Figure 6:
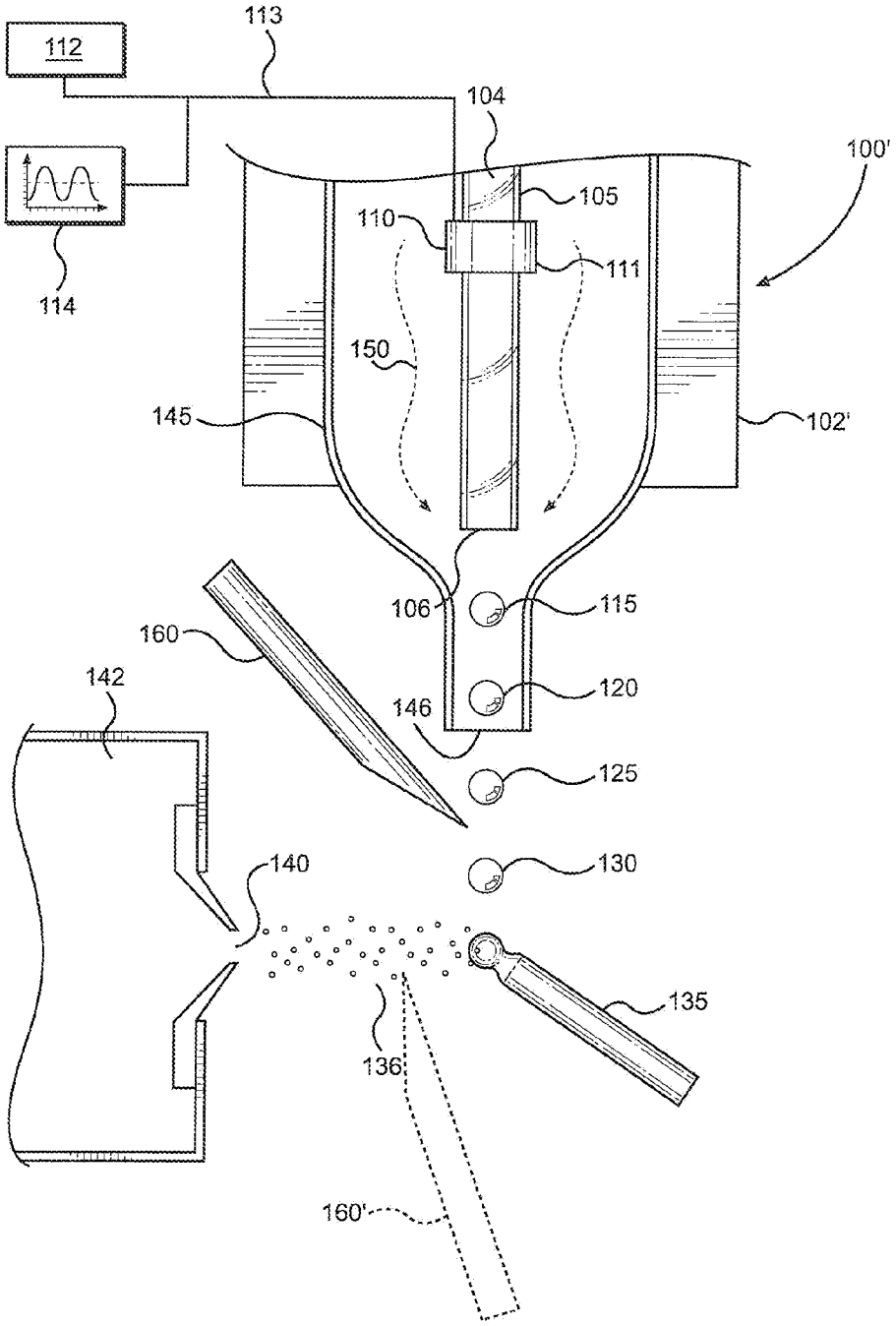
FIG. 6 shows the ion source of FIG. 2 with a corona discharge pin.

Referring now to FIG. 6, there is shown an embodiment of the present invention that incorporates capillary gas flow 150 and corona discharge pin 160 into impactor spray ion source 100' for enhancing ionization and the sensitivity of the technique. In this embodiment, droplets 115, 120, 125, 130 are imbued with kinetic energy from capillary gas flow 150 as they emerge from exit 146 of second capillary tube 145. Upon exiting droplet generator 102', droplets 115, 120, 125, 130 are exposed to corona discharge pin 160, which is located in the path of droplets 115, 120, 125, 130, between droplet generator 102' and target 135. Alternatively, corona discharge pin 160' is incorporated into impactor spray ion source 100' such that corona discharge pin 160' is in the path of ion stream 136, oriented so as to be in between target 135 and inlet 140.

Figure 7:
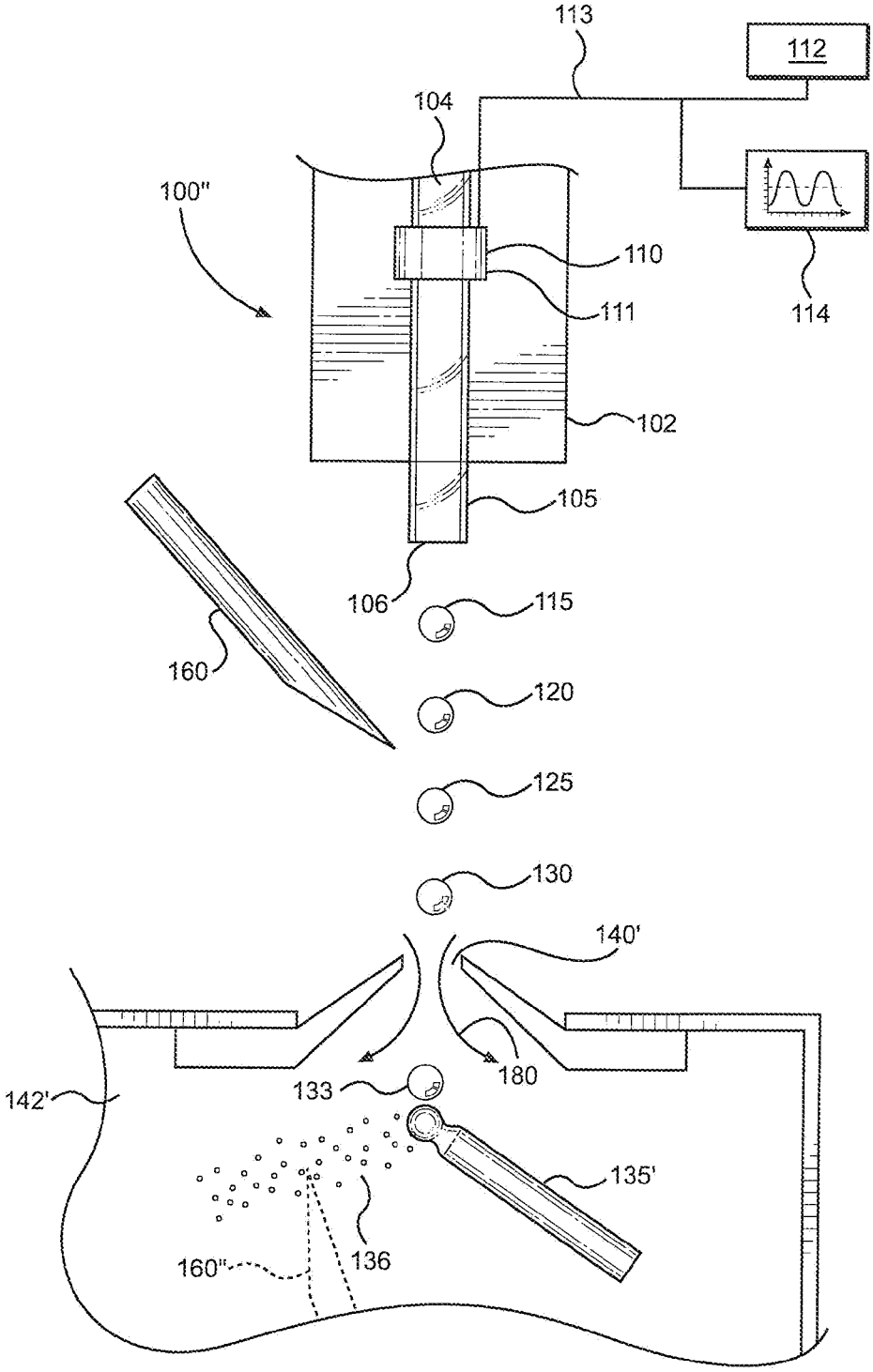
FIG. 7 shows the ion source of FIG. 3 with a corona discharge pin.

Similarly, FIG. 7 shows an embodiment of impactor spray ion source 100" where droplet generator 102 is aligned so that droplets 115, 120, 125, 130 and 133 enter directly into inlet 140' of mass spectrometer 142' before impacting upon target 135' to create an ion stream 136. Droplets 115, 120, 125, 130, 133 are exposed to corona discharge pin 160 before entering inlet 140' of mass spectrometer 142' because corona discharge pin 160 is located in the path of droplets 115, 120, 125, 130, 133, between droplet generator 102 and inlet 140'. In this embodiment, inlet gas flow 180 imparts kinetic energy to droplets 115, 120, 125, 130, 133 as they enter mass spectrometer 142' through inlet 140' to impact upon target 135'. Since ionization occurs inside mass spectrometer 142', there is improved ion collection efficiency and enhanced sensitivity. Alternatively, subsequent to impacting upon target 135' to form ion stream 136, the proportion of ions in ion stream 136 may be enhanced by exposing ion stream 136 to corona discharge pin 160", which is located inside mass spectrometer 142', adjacent inlet 140' and target 135'. There is improved ion collection efficiency and enhanced sensitivity due to the fact that both ionization and exposure to corona discharge pin 160" occur inside mass spectrometer 142'.

Figure 8:
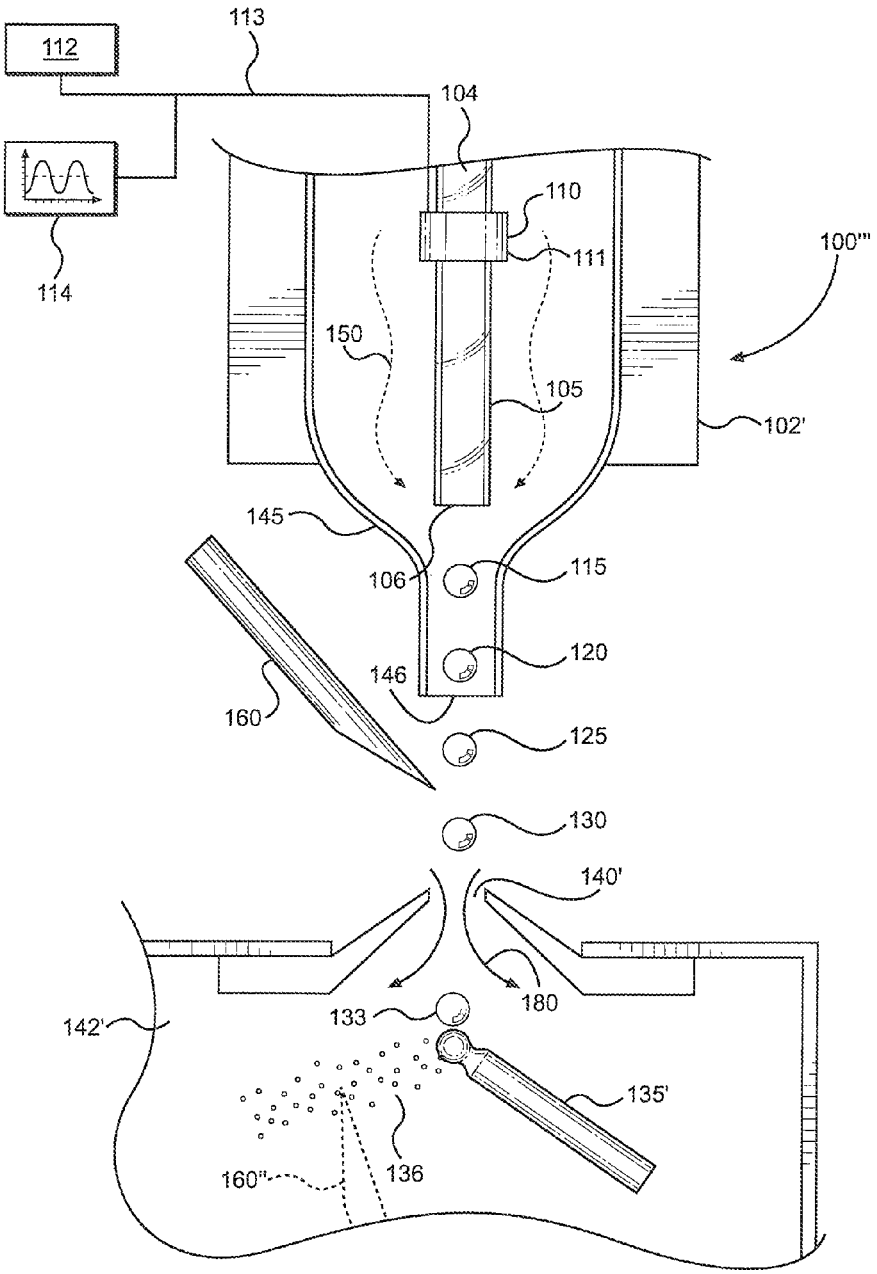
FIG. 8 shows the ion source of FIG. 4 with a corona discharge pin.

FIG. 8 also shows an embodiment of impactor spray ion source 100'" which incorporates capillary gas flow 150 and inlet gas flow 180 to aid in imparting kinetic energy to droplets 115, 120, 125, 130, 133, formed by droplet generator 102', as droplets 115, 120, 125, 130, 133 enter mass spectrometer 142'. Target 135' is located inside inlet 140' of mass spectrometer 142'. Corona discharge pin 160 is oriented between droplet generator 102' and inlet 140', external to inlet 140'. The multiple gas flows imbue kinetic energy and increased velocity to droplets 115, 120, 125, 130, 133 formed by droplet generator 102'. The alignment of droplet generator 102' and inlet 140' provides a direct path for droplets 115, 120, 125, 130, 133 to enter mass spectrometer 142' before impacting upon target 135' to create ion stream 136 to be analyzed. Alternatively, subsequent to impacting upon target 135' to form ion stream 136, the proportion of ions in ion stream 136 may be enhanced by exposing ion stream 136 to corona discharge pin 160", which is located inside mass spectrometer 142', adjacent inlet 140' and target 135'. The multiple gas flows imbue kinetic energy and increase the velocity of droplets 115, 120, 125, 130, 133 before they impact upon target 135'.

Targets 135 and 135' and corona discharge pins 160, 160' and 160", described in FIGS. 1 through 8 above, are manipulated in vertical and/or horizontal directions to optimize ion generation. The electrical potentials applied to targets 135 and 135' and corona discharge pins 160, 160' and 160" in the embodiments described in the FIGS. 1 through 8 are preferably constant, but sinusoidal or non-sinusoidal AC or RF applied potentials are also contemplated. Embodiments are contemplated where targets 135 and 135' are made from a variety of materials, including, but not limited to, stainless steel, metal, gold, a non-metallic substance, a semiconductor, a metal or other substance with carbide coating, an insulator or a ceramic.

Based on the above, it should be readily apparent that the present invention improves ion collection efficiency and enhances sensitivity of the impact spray ionization technique by implementing a variety of approaches to impart kinetic energy to, and increase the velocity of, analyte droplets prior to impacting upon a target. The various approaches disclosed herein can be utilized individually or in any combination. By producing droplets of a uniform size via the use of a controlled droplet generator, introducing the droplets into a capillary gas flow that carries the droplets through a narrowed portion of the second capillary tube, or by introducing the droplets to a pressure drop across the inlet of a mass spectrometer, the droplets that impact upon the target in the present invention more effectively produce an ion stream than conventional pneumatically assisted nebulizer ionization techniques. Furthermore, a greater quantity of ions produced by the droplet impact ultimately enters the mass spectrometer for analysis compared to known nebulizer techniques.

Although the present invention has been described with reference to preferred embodiments it will be apparent to those skilled in the art that various changes in form and detail may be made without departing from the scope of the invention as defined by the accompanying claims.

The invention claimed is:

1. An ion source for producing an ion stream from a sample for a mass spectrometer, the ion source comprising:

a droplet generator including:

a first capillary tube having an exit; and an actuator configured to expel a droplet from the first capillary tube through the exit in response to receiving an electrical signal; and a target, wherein the ion source is configured to apply an electric potential to the target without forming a corona discharge, and wherein the droplet generator is configured so that droplets exiting the first capillary tube are caused to impact upon the target, thus forming the ion stream.

2. The ion source of claim 1, wherein the droplet generator is configured to provide a gas flow that increases a kinetic energy of the droplets.

3. The ion source of claim 2, wherein the droplet generator further includes a second capillary tube surrounding the first capillary tube, the second capillary tube configured to provide the gas flow that increases the kinetic energy of the droplets.

4. The ion source of claim 3, wherein the second capillary tube is concentric with the first capillary tube and the exit of the first capillary tube is located within the second capillary tube.

5. The ion source of claim 1, wherein the actuator includes a piezoelectric element, said ion source further comprising:

an electrical source configured to supply the electrical signal to the piezoelectric element, wherein the electrical signal includes electrical pulses at a preset frequency, thereby producing droplets at the preset frequency.

6. The ion source of claim 5, wherein the preset frequency is between 100 Hz and 15 kHz.

7. The ion source of claim 1, wherein the exit of the first capillary tube has a diameter that is greater than a preset value and the droplets have diameters substantially the same as the diameter of the first capillary tube.

8. The ion source of claim 7, wherein the preset value is at least 30 μm.

9. The ion source of claim 1, wherein the target is positioned upstream of an inlet of the mass spectrometer so that the ion stream enters the inlet of the mass spectrometer.

10. The ion source of claim 1, wherein the target is positioned downstream of an inlet of the mass spectrometer so that the droplets enter the inlet of the mass spectrometer.

11. The ion source of claim 10, wherein the inlet is provided with a pressure drop that increases a kinetic energy of the droplets.

12. An ion source for producing an ion stream from a sample for a mass spectrometer, the ion source comprising:

a droplet generator including:

a first capillary tube having an exit; and an actuator configured to expel a droplet from the first capillary tube through the exit in response to receiving an electrical signal;

a target, wherein the droplet generator is configured so that droplets exiting the first capillary tube are caused to impact upon the target, thus forming the ion stream; and a corona discharge pin positioned so that the droplets or the ion stream pass by the corona discharge pin.

13. A method of producing an analyte ion stream from a sample for a mass spectrometer, comprising:

receiving an electrical signal;

expelling, with an actuator of a droplet generator, droplets from an exit of a first capillary tube in response to receiving the electrical signal;

applying an electric potential to a target without forming a corona discharge; and causing droplets exiting the first capillary tube to impact the target in order to form the ion stream.

14. The method of claim 13, further comprising:

providing, with the droplet generator, a gas flow that increases a kinetic energy of the droplets.

15. The method of claim 14, wherein providing the gas flow with the droplet generator includes providing the gas flow with a second capillary tube that surrounds the first capillary tube.

16. The method of claim 13, wherein the actuator includes a piezoelectric element, said method further comprising:

supplying, with an electrical source, the electrical signal to the piezoelectric element, the electrical signal including pulses at a preset frequency; and producing droplets at the preset frequency.

17. The method of claim 16, wherein producing droplets at the preset frequency includes producing droplets at a frequency between 100 Hz and 15 kHz.

18. The method of claim 13, wherein expelling the droplet with the actuator includes expelling a droplet having a diameter of at least 30 μm.

19. The method of claim 13, further comprising:

positioning the target downstream of an inlet of a mass spectrometer so that the droplets enter the inlet; and providing the inlet with a pressure drop that increases a kinetic energy of the droplets.

20. A method of producing an analyte ion stream from a sample for a mass spectrometer, comprising:

receiving an electrical signal;

expelling, with an actuator of a droplet generator, droplets from an exit of a first capillary tube in response to receiving the electrical signal;

causing droplets exiting the first capillary tube to impact a target in order to form the ion stream; and positioning a corona discharge pin so that the droplets or the ion stream pass by the corona discharge pin.

21. The ion source of claim 1, wherein the target is an impactor pin.

22. The method of claim 13, wherein causing droplets exiting the first capillary tube to impact the target includes causing droplets exiting the first capillary tube to impact an impactor pin.

* * * * *